US005139385A

United States Patent [19]

Chase et al.

[11] Patent Number: 5,139,385

[45] Date of Patent: Aug. 18, 1992

[54] DUAL PALLET FORK ATTACHMENT FOR A LIFT TRUCK

[75] Inventors: Daniel F. Chase, Longview; Robert J. Kroupa, Tacoma, both of Wash.; Emmett C. Frison, Portland, Oreg.

[73] Assignee: Swingshift Manufacturing, Inc., Ridgefield, Wash.

[21] Appl. No.: 504,586

[22] Filed: Apr. 3, 1990

[51] Int. Cl.[5] ..... B66F 9/14

[52] U.S. Cl. ..... 414/667

[58] Field of Search ..... 414/662, 663, 664, 667, 414/668, 671, 607, 785; 187/9 R, 9 E

[56] References Cited

U.S. PATENT DOCUMENTS

| | | | |
|---|---|---|---|
| 2,985,328 | 5/1961 | Fitch | 414/667 |
| 2,995,263 | 8/1961 | Fitch | 414/667 |
| 3,184,088 | 5/1965 | Berge | 414/667 X |
| 3,387,731 | 6/1968 | Gibson et al. | 414/667 X |
| 3,684,113 | 8/1972 | Roller | 414/667 X |
| 3,754,673 | 8/1973 | Barda et al. | 414/667 |
| 4,335,992 | 6/1982 | Reeves | 414/667 |
| 4,523,886 | 6/1985 | Reeves | 414/667 X |
| 4,533,290 | 8/1985 | Hackauf | 414/671 |
| 4,869,635 | 9/1989 | Krahn | 414/667 X |
| 4,902,190 | 2/1990 | House | 414/667 |

FOREIGN PATENT DOCUMENTS 3515524 11/1986 Fed. Rep. of Germany ..... 414/667

OTHER PUBLICATIONS

Waldon 2-or-1 Pallet Handler, 1-p. Brochure, WL 1121-88-5M Fairview, Okla.

"Attachments Increase Pallet Handling Efficiency" 1-p. reprint from Modern Materials Handling, 1989, Cahners Publishing Co.

*Primary Examiner*—Robert J. Spar
*Assistant Examiner*—Brian K. Dinicola
*Attorney, Agent, or Firm*—Robert L. Harrington

[57] ABSTRACT

The attachment (20) provides inner forks (54, 56) and outer forks (58, 60) that are directly and independently driven for handling juxtaposed pallets. The fork assembly (26) is carried by guide members (44, 48, 62, 66) that are constructed so that when two juxtaposed pallet loads are carried, there is substantially no downward deflection of the laterally outermost portions of the loads. A hydraulic control system is included for controlling the four operation functions performed by the attachment (20). The hydraulic control circuit is designed so that no electrical components need be mounted to the attachment (20).

12 Claims, 9 Drawing Sheets

DUAL PALLET FORK ATTACHMENT FOR A LIFT TRUCK

TECHNICAL FIELD

This invention is directed to fork attachments for lift trucks.

BACKGROUND INFORMATION

Lift trucks are well-known vehicles for handling loads. Typically, the load is carried by a pair of forwardly projecting forks that are attached to the carriage of the lift truck. The carriage is driven for lifting and lowering the forks.

Loads moved by lift trucks are often placed on pallets. To relocate loaded pallets, the lift truck is moved so that the forks are inserted through pockets in the pallets. The forks are then lifted and the pallet is moved.

Fork lift attachments that allow a lift truck to simultaneously handle two pallets are presently available. Such attachments (hereafter referred to as dual pallet fork attachments) generally include two outer forks and two inner forks. The inner forks are located between the outer forks. A hydraulic control system is used for laterally spreading the forks so that the forks engage the pockets of two juxtaposed pallets. Alternatively, the inner and outer forks may be moved into a position for use as a single fork pair to carry a single pallet.

In moving two pallets, it is often desirable to spread apart the pallets. For example, after two loaded pallets are moved into a trailer, the loads are spread apart against the walls of the trailer so that the overall load is evenly distributed and stabilized within the trailer.

The forks of dual pallet fork attachments are mounted to a guide assembly that guides the lateral movement of the forks. The hydraulic control systems and guide assemblies of conventional dual pallet fork attachments are designed so that only the outer forks are directly driven by the hydraulic system. The inner forks are coupled to the outer forks to slide outwardly when the outer forks are driven outwardly (that is, when the attachment is used for moving two juxtaposed pallets). As the forks are spread to engage two pallets, the maximum distance between the inner forks is established by mechanical stops that halt the outward sliding of the inner forks. The outer forks move outwardly beyond the stops into a position where an outer fork and an adjacent inner fork can engage one pallet, and the other outer fork and adjacent inner fork can engage the other pallet.

As the outer forks are driven toward one another (for example, when the attachment is to be used for handling a single pallet), they push the inner forks inwardly, until the inner forks abut mechanical stops that define the minimum distance between the inner forks.

In instances where two pallets are to be moved by the attachment, it is sometimes necessary to change the position of the inner forks relative to the outer forks. For example, one of two juxtaposed pallets may have a somewhat dissimilar pocket configuration relative to the other pallet. Consequently, the distance between the innermost pockets (that is, the pockets that receive the inner forks) may be greater or lesser than the maximum distance between the inner forks as defined by the mechanical stops mentioned above. As a result, the innermost forks must be moved inwardly or outwardly to align with the inner pockets. With the dual pallet fork attachments of the type just described, any such changes in the position of the inner forks (while the outer forks remain spread to engage the outermost pockets) must be performed manually by the lift truck operator.

As noted, the inner and outer forks are mounted to a guide assembly that supports and guides lateral movement of the forks. The guide assembly is generally disposed between the vertical legs of the forks and the lift truck carriage. The structural components of the guide assembly must be strong enough to resist the moment of force that is generated when the forks are loaded. It is also desirable, however, to minimize the size of the guide assembly components so that the forks may be placed as near as possible to the lift truck carriage because the load carrying capacity of the lift truck is reduced as the distance between the forks and carriage is increased. The distance between the forward surface of the lift truck carriage and the forward surfaces of the vertical legs of the forks is known as the lost load distance. In short, it is desireable to minimize the lost load distance. Moreover, reducing the size of the attachment components reduces the weight of the attachment, hence increasing the carrying capacity of the attachment.

The versatility of a dual pallet fork attachment is enhanced when the attachment includes a mechanism known as a side shifter. Side shifters provide for simultaneous lateral movement of both pairs of forks relative to the carriage. Side shifters eliminate a substantial amount of lift truck movement that would otherwise be required to achieve such movement of loads or forks.

SUMMARY OF THE INVENTION

This invention is directed to a dual pallet fork attachment that provides inner and outer fork pairs that are directly and independently driven, thereby increasing the effectiveness of the attachment for handling juxtaposed pallets that have dissimilar pocket orientations.

The inner forks are driven inwardly or outwardly and may be positioned at any of a wide range of positions irrespective of movement of the outer forks. Each outer fork is independently driven laterally inwardly and outwardly. Accordingly, the inner forks may be aligned with the innermost pockets of two juxtaposed pallets (even though the two pallets may have dissimilar pocket arrangements), and each outer fork may be thereafter moved into alignment with the outermost pockets.

As another aspect of this invention, the inner and outer forks are mounted to a guide assembly that is constructed to support a given load moment with components that are sized to be smaller than those used in heretofore available dual pallet fork attachments. As a result, the lost load distance and weight attributable to the attachment is minimized with the present invention.

As another aspect of this invention, the guide assembly is constructed so that when two juxtaposed pallets are carried there is substantially no downward deflection of the laterally outermost portions of the loads. Accordingly, load stability is maintained.

As another aspect of this invention, the attachment includes a side shifter mechanism for providing simultaneous lateral movement of all forks relative to the life truck carriage. Accordingly, the fork attachment of the present invention provides four hydraulically controlled functions: (1) simultaneous side shifting movement of all forks, (2) spreading movement of the inner forks, (3) movement of one of the outer forks, and (4) movement of the other one of the outer forks.

As another aspect of this invention, a hydraulic control system is included for controlling each of the functions just described. The control system is designed to permit the operator to control each function without leaving the operator's seat of the lift truck. Moreover, the control system provides a hydraulic circuit that does not require mounting of any electrical components (for example, solenoids) to the attachment. Accordingly, the attachment may be used without the need for electrical cables extending between the lift truck and the attachment.

DETAILED DESCRIPTION OF THE PREFERRED EMBODIMENT

Figure 1:
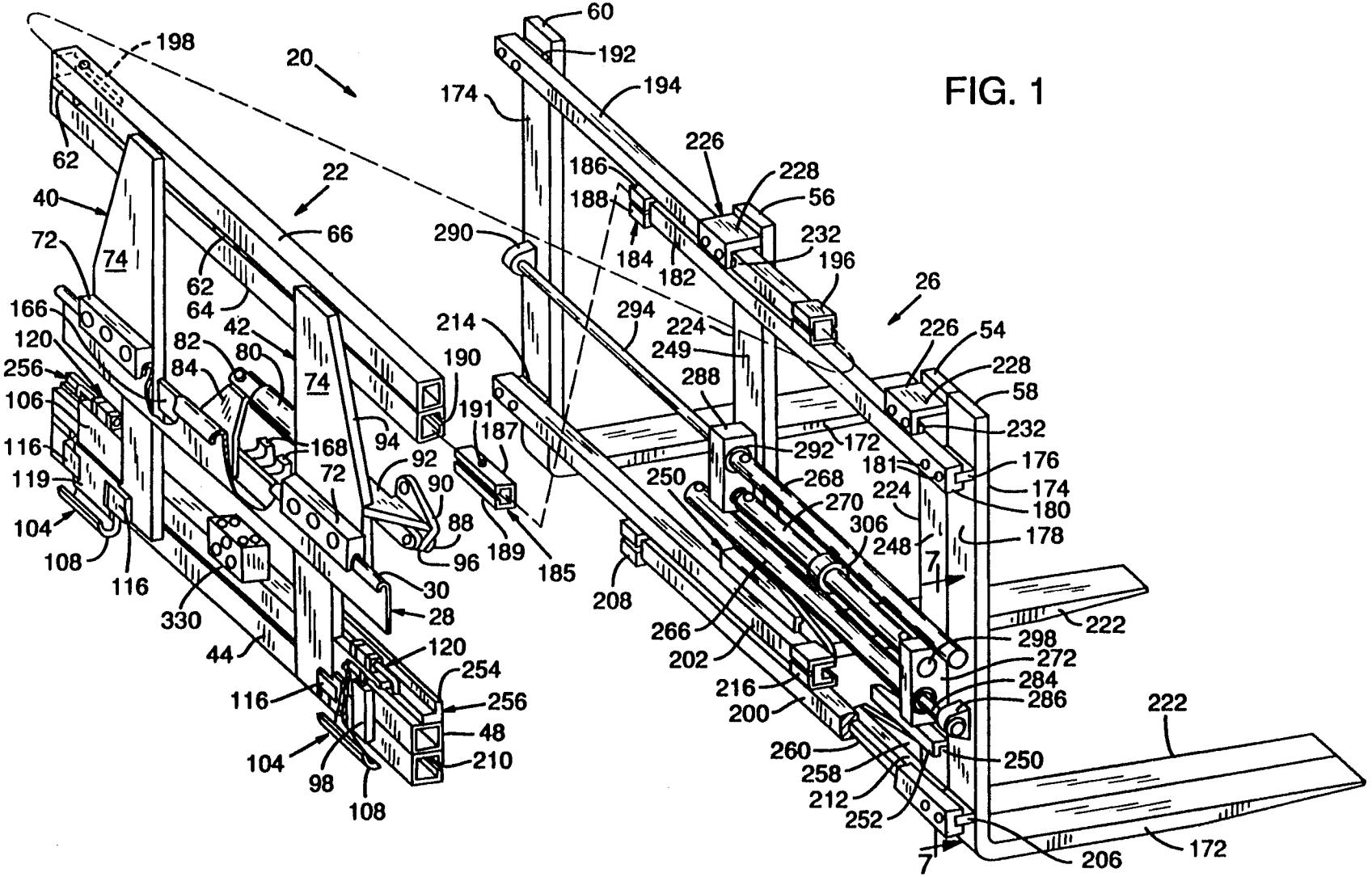
FIG. 1 is a perspective exploded view of a dual pallet fork attachment formed in accordance with the present invention.
Figure 2:
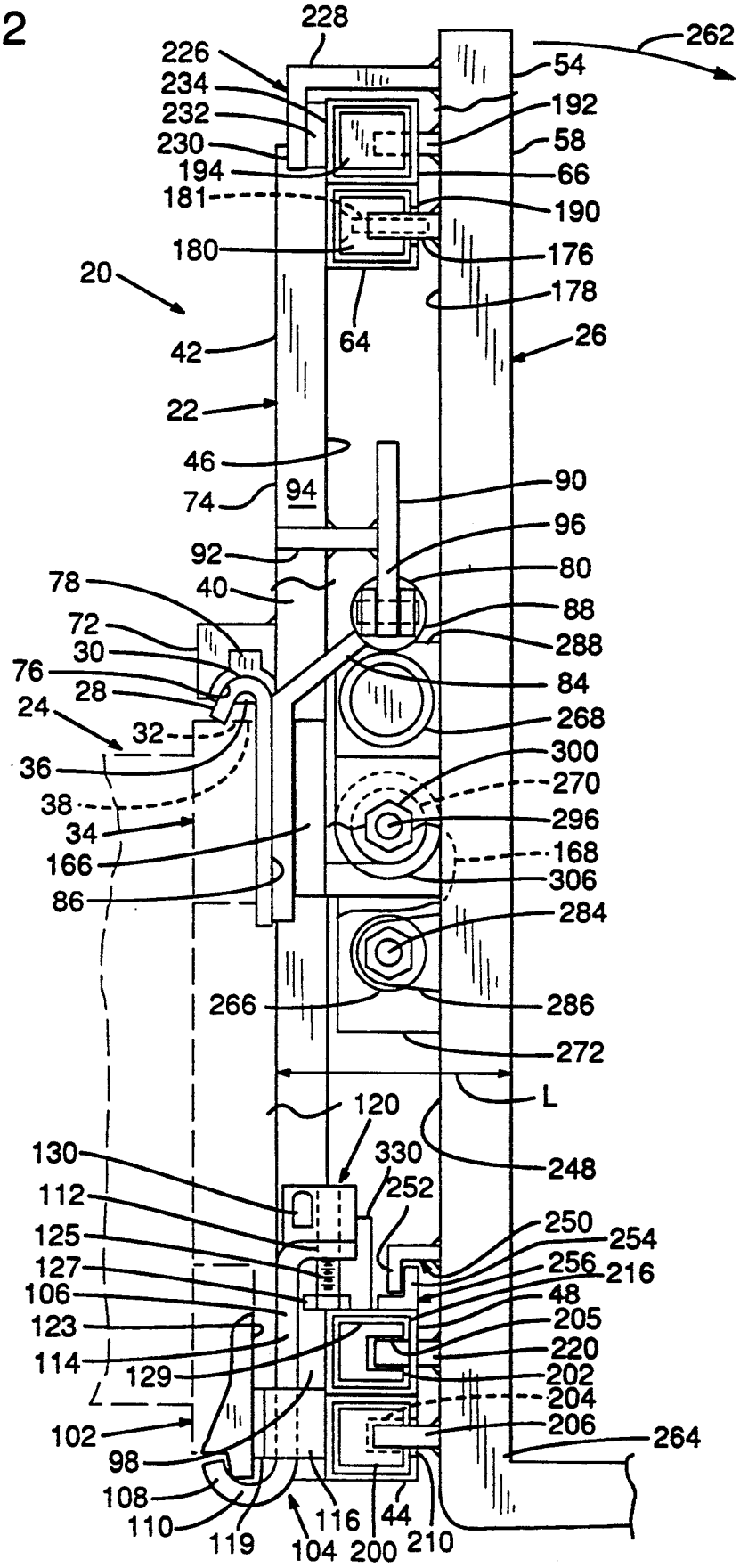
FIG. 2 is a side elevation view of the assembled fork attachment.
Figure 3:
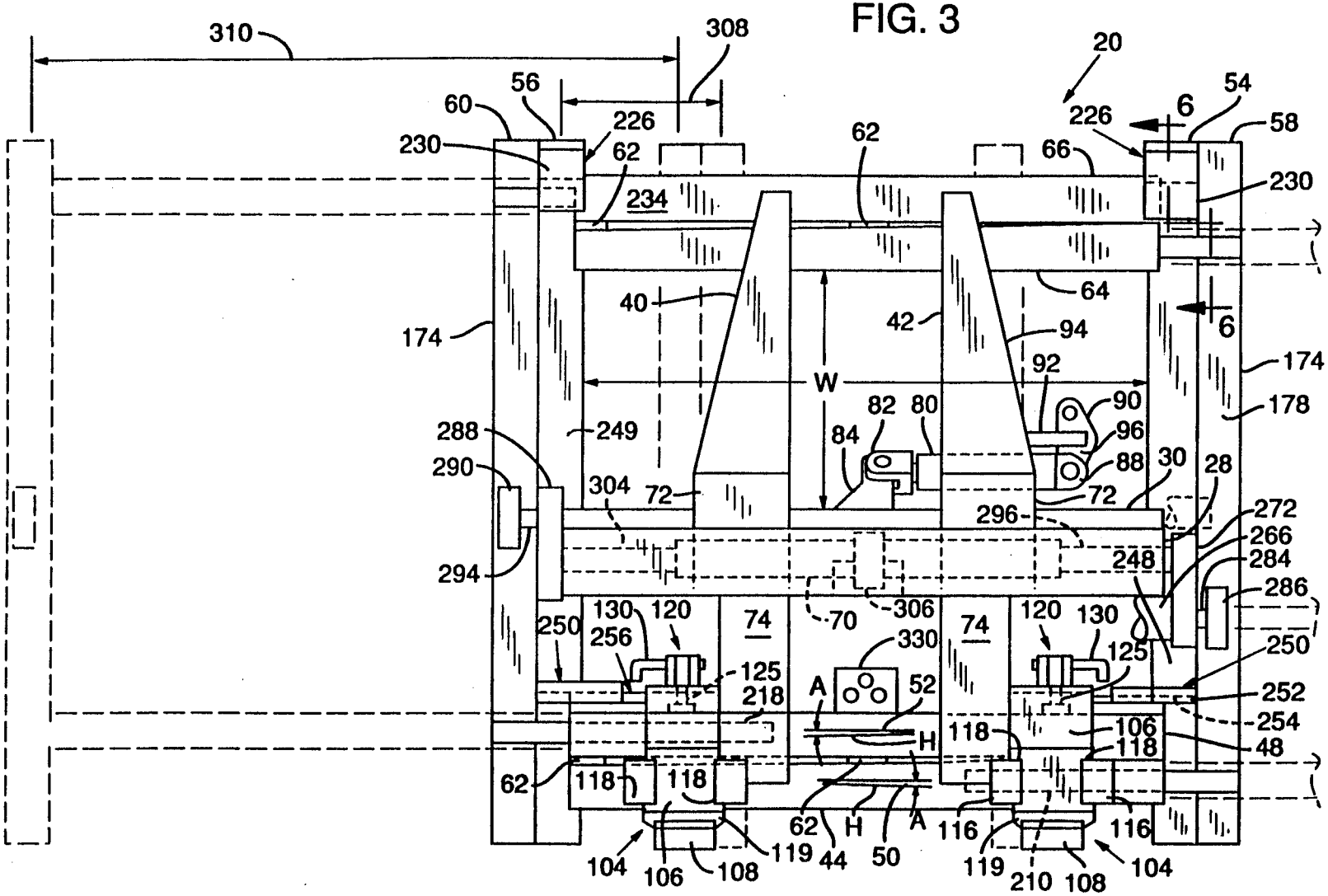
FIG. 3 is a back elevation view of the fork attachment.

With reference to FIGS. 1–3, a dual pallet fork attachment 20 of the present invention includes a frame 22 that mounts to a lift truck carriage 24 (FIG. 2), and a fork assembly 26 that is carried by the frame 22.

The frame 22 includes a rigid elongated anchor plate 28 that has a rounded upper end 30. The upper end 30 of the plate 28 rests upon the upwardly projecting lip 32 that is found on the top of the upper crossbar 34 of a conventional lift truck carriage 24. The upper end 30 of the anchor plate includes a central, downwardly projecting lug 36 that mates with a correspondingly shaped notch 38 formed in the carriage crossbar lip 32. The mated lug 36 and notch 38 keep the anchor plate 28 from moving laterally (that is, into and out of the plane of FIG. 2) relative to the carriage crossbar 34.

The frame 22 also includes two spaced apart vertical support members, designated left vertical support member 40 and right vertical support member 42. Preferably, the support members 40, 42 are spaced apart a distance that corresponds to the distance between the masts of the lift truck carriage. Consequently, the support members do not diminish the operator's view of the fork assembly 26.

Elongated guide tubes 44, 48, 64, 66 are fastened to the vertical support members 40, 42 for guiding lateral movement of the forks 54, 56, 58, 60 that form part of the fork assembly 26. More particularly, a lower right guide tube 44 having a generally square cross section is fastened to, and extends between, the forward surfaces 46 of the vertical support members 40, 42 at the lower ends of the support members. Similarly, a lower left guide tube 48 is fastened to, and extends between, the forward surfaces 46 of the vertical support members 40, 42 above and near the lower right guide tube 44.

As best shown in FIG. 3, the lower guide tubes 44, 48 are mounted to the vertical support members 40, 42 in an orientation such that the longitudinal axes of the tubes are inclined relative to a horizontal plane. More particularly, the longitudinal axis 50 of the lower right guide tube 44 is inclined upwardly from a horizontal plane (shown as line H in FIG. 3) in the direction from left to right by an angle A. The longitudinal axis 52 of the lower left guide tube 48 is inclined upwardly from a horizontal plane H in the direction from right to left by the same angle A. Preferably, rigid spacers 62 are placed between guide tubes 44, 48 at the center and at one end of the tubes 44, 48 (FIG. 3). The spacers 62 maintain the inclination described above. Preferably, the inclination angle A is established at about 0.5°.

As will become clear upon reading this description, the inclination of the guide tubes 44, 48 is such that the forwardly projecting legs of the outer forks 58, 60 of the fork assembly 26 remain substantially level with the forwardly projecting legs of the inner forks even as the outer forks are spread outwardly when the attachment is used for carrying two pallets. Put another way, the inclination of the guide tubes 44, 48 improves load stability by placing the forks in a position that ensures that juxtaposed pallet loads do not sag downwardly at the outer forks. Elimination of the sag is also important for moving the loads into close-fitting containers.

Because the inner and outer forks remain level as just described, the ease with which the forks are inserted into pallet pockets is maintained. In this regard, a prior attempt to eliminate outer fork sag lead to a fork construction wherein the outer forks were raised relative to the inner forks. Such a construction complicates insertion of the forks into the pallet pockets because the raised forks may be slightly higher than the pockets into which they are to be inserted.

A second pair of guide tubes 64, 66 having generally square cross sections are attached to, and extend between, the forward surfaces 46 of the vertical support members 40, 42 near the upper ends of the support members. The upper guide tubes 64, 66 are arranged in a manner similar to the lower guide tubes 44, 48. Specifically, the upper right guide tube 64 is attached so that the longitudinal axis 68 of that tube is parallel to the longitudinal axis 50 of the lower right guide tube 44. The upper left guide tube 66 is attached so that the longitudinal axis 70 of that tube is parallel to the longitudinal axis 52 of the lower left guide tube 48. As with the lower guide tubes 44, 48, spacers 62 are placed between the guide tubes 64, 66 at the center and at one end of the tubes (FIG. 3). The spacers 62 maintain the inclination of the tubes 64, 66 as just described.

The vertical support members 40, 42 are mounted to the anchor plate 28 in a manner such that the entire fork assembly 26 may be laterally shifted relative to the carriage 24. This lateral shifting of the fork assembly 26 is referred to as the side shifting function. More particularly, the vertical members 40, 42 are mounted to slide along the anchor plate 28. To this end, a slide bracket 72 (FIG. 2) is mounted to the back surface 74 of each vertical support member 40, 42. Each slide bracket 72 includes a downwardly opening groove 76. A low-friction slide bearing 78, formed of material such as that manufactured by Polymer Corporation, Philadelphia, Pa., under the trademark NYLATRON, is fit into each groove 76. The slide bearing 78 rests upon the upper rounded end 30 of the anchor plate 28.

The frame 22 (hence, the fork assembly 26 carried by the frame) is driven to slide along the anchor plate 28 by a hydraulically-driven shift cylinder 80. The rod end of the shift cylinder 80 carries a clevis bracket 82 that is pinned to the upper end of a rigid first mounting bracket 84. As best shown in FIG. 2, the first mounting bracket 84 angles downwardly from the clevis bracket 82 toward the anchor plate 28. At a location near the anchor plate 28, the bracket 84 bends downwardly and is fastened, as by welding, against the forward surface 86 of the anchor plate 28.

The closed end of the shift cylinder 80 is mounted, via an attached clevis bracket 88, to a second mounting bracket 90. The second mounting bracket 90 includes a horizontal plate 92 that is notched to fit against, and be welded to, the forward surface 46 and outer edge surface 94 of the right vertical support member 42.

The second mounting bracket 90 also includes a vertical plate 96 that is fastened to the horizontal plate 92 to extend downwardly therefrom. The clevis bracket 88 on the closed end of the shift cylinder 80 is pinned to the vertical plate 96 of the second mounting bracket 90.

The shift cylinder 80 is a dual-action type, to which hydraulic fluid is fed and returned as described more fully below. Actuation of the shift cylinder 80 slides the frame 22 laterally relative to the anchor plate 28.

The lower end of the frame 22 is secured adjacent to and in sliding contact with the lower crossbar 102 of the lift truck carriage by retainers 104. Preferably, two retainers 104 are mounted in spaced apart relationship to the rearward surface of the lower right guide tube 44. Each retainer 104 comprises a rigid unitary plate 106 that is formed from, for example, a steel plate. The lower end of the retainer plate 106 is bent rearwardly (that is, to the left in FIG. 2) to form a hook 108 that is sized to engage the downwardly projecting lip 110 that is found on the underside of the lower crossbar 102 (FIG. 2). The upper end of the retainer plate 106 forms a flange 112 that projects forwardly in a plane perpendicular to the plane of the generally flat mid-portion 114 of the retainer plate 106. A spacer bar 98 is fastened to the rearward surface of the guide tubes 44, 48 to position the retainer plate at the appropriate distance from the carriage crossbar 102 (when the anchor plate 28 is mounted to the upper crossbar 34) so that the hook 108 of the retainer aligns with the lip 110.

Each retainer 104 is held between two rigid mounting brackets 116 that are fastened, such as by welding, to the lower right guide tube 44. Each mounting bracket 116 is formed with a tongue 118 that extends partly over the mid-portion 114 of the retainer plate 106. The brackets 116 are sized so that the retainer plate 106 is able to slide upwardly and downwardly for position adjustment as described more fully below. With the retainer plate 106 between the mounting brackets 116, a slide block 119 formed of low-friction material, such as ultra-high molecular weight (UHMW) polyethylene, is press-fit between the tongues 118 of the brackets 116. The slide block 119 include notches formed in the vertical edges. The tongues 118 fit within the notches in the side block 119, thereby keeping the slide block immovable in the vertical direction relative to the brackets 116.

As best seen in FIG. 2, the slide block 119 is of sufficient thickness so that the block 119 bears against the vertical forward surface 123 of the lower crossbar 102 of the carriage to facilitate lateral sliding of the frame 22 relative to the lower crossbar 102.

Figure 4:
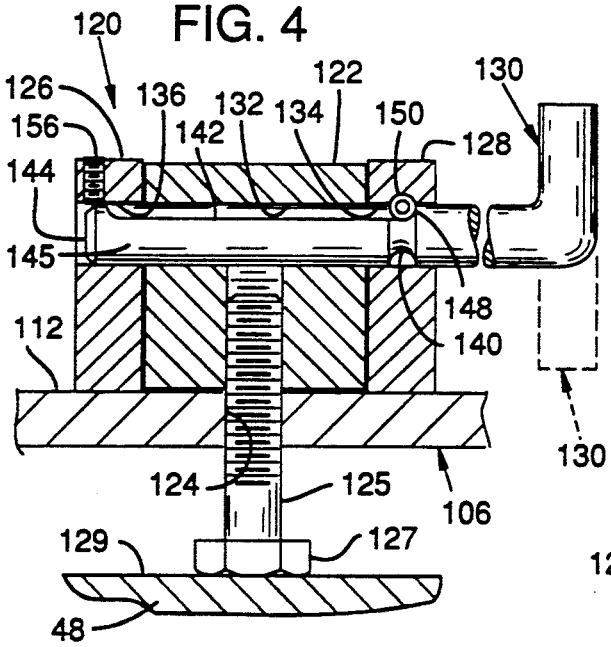
FIG. 4 is an enlarged cross-sectional view of a portion of a quick-detach retainer mechanism for securing the attachment to a lift truck carriage.
Figure 5:
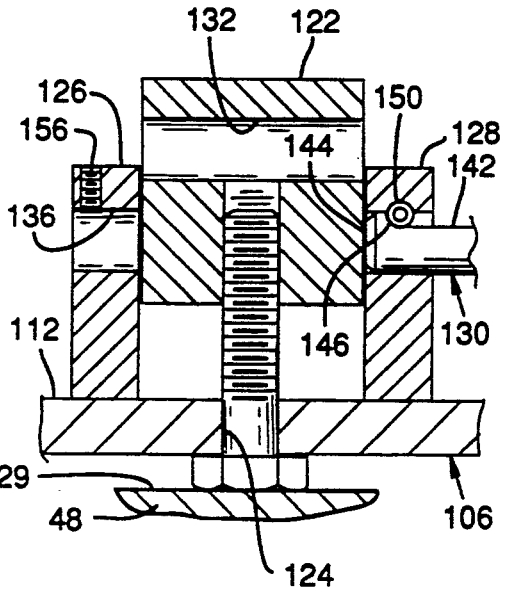
FIG. 5 is a cross-sectional view similar to FIG. 4 showing the retainer mechanism in a release position.

The hook 108 of retainer plate 106 may be quickly moved into and out of engagement with the carriage crossbar 102 by a quick-detach mechanism 120 (see FIGS. 3–5).

The quick-detach mechanism 120 includes a cuboidal coupling block 122 that is tapped to receive the upwardly projecting threaded end of an adjustment bolt 125 that has a head 127 resting upon the upper horizontal surface 129 defined by the top surface of the spacer bar 98 and the adjacent surface of the lower left guide tube 48. A hole 124 in the retainer plate flange 112 through which the bolt 125 extends is clear, having a diameter slightly greater than that of the bolt shaft.

The coupling block 122 is disposed between two flat coupling plates 126, 128. Each coupling plate 126, 128 is fastened to extend upwardly from the upper surface of the flange 112.

The coupling block 122 (hence the bolt 125) is releasably coupled to the coupling plates 126, 128 by a coupling pin 130. Specifically, a hole 132 is formed through the coupling block 122 along an axis that is perpendicular to the axis of the bolt 125. Each coupling plate 126, 128 includes a hole 134, 136 near the upper end thereof. The holes 134, 136 in the coupling plates are concentric.

Whenever the retainer plate 106 is lifted from a lowered position (FIG. 5) into the raised position (FIG. 4), the hole 132 in the coupling block 122 is concentrically aligned with the holes 134, 136 in the coupling plates 126, 128. When so aligned, the coupling pin 130 is inserted through all three holes 132, 134, 136 to couple the coupling block 122 and coupling plates 126, 128, thereby holding the retainer plate 106 in the raised position so that the hook 108 of the retainer plate engages the lip 110 on the carriage crossbar 102.

To disengage the retainer plate 106 from the lower crossbar 102 (that is, to move the retainer plate 106 to the lowered position, the pin 130 is withdrawn from the hole 132 in the coupling block 122, thereby permitting the retainer plate 106 to drop downwardly into the lowered position (FIG. 5).

The quick-detach mechanism 120 is configured so that the coupling pin 130 may not be completely removed from the mechanism. Moreover, the pin 130 may be slid to couple and uncouple the coupling block 122 only when rotated into a particular position. More particularly, the coupling pin 130 includes an annular groove 140 formed therein. The groove 140, which is semi-circular in cross section, is located so that it is positioned within the coupling plate 126 whenever the pin 130 is inserted through the coupling block 122 (FIG. 4).

The coupling pin 130 also includes a flattened surface 142 extending along one side thereof between the groove 140 and a location near the inserted end 144 of the coupling pin 130. The flat surface 142 is recessed from the curved outer surface 145 of the coupling pin 130 by a depth corresponding to the depth of the annular groove 140. Shoulders 146, 148 are defined at the opposing ends of the flat surface 142.

A roll pin 150 is lodged within the coupling plate 126 to extend in a direction substantially perpendicular to that of the coupling pin 130. The roll pin 150 protrudes into the hole 134 in the coupling plate 126 by an amount sufficient to permit the roll pin 150 to fit closely within the annular groove 140 in the coupling pin 130. The roll pin 150, disposed as it is between the two shoulders 146, 148 in the coupling pin 130, captures the coupling pin 130 so that the coupling pin may not be removed from the coupling plate 126. Moreover, the coupling pin 130 may be withdrawn from the hole 132 in the coupling block 122 only when the pin 130 is rotated (as shown in solid lines in FIG. 4) about its longitudinal axis so that the flat surface 142 is immediately beneath the roll pin 150 in a plane perpendicular to the longitudinal axis of the roll pin. It can be appreciated, therefore, that once the coupling pin 130 is inserted to couple the coupling plates 126, 128 and the coupling block 122, the coupling pin 130 may be rotated out of the position shown in solid lines in FIG. 4 to seat the roll pin 150 within the annular groove 140, thereby prohibiting inadvertent withdrawal of the coupling pin 130.

Preferably, the coupling pin 130 will be substantially irrotatable in the absence of manual force. Such an irrotatable pin reduces the possibility of external forces, such as vibration, causing the pin to rotate and slip out of the hole 132 in the coupling block 122, thereby causing the retainer plate 106 to disengage from the carriage crossbar 102. One mechanism for preventing such unwanted rotation to the pin 130 is a set screw 156 that is threaded into the coupling plate 128 to extend slightly into the hole 136 through which the inserted end 144 of the coupling pin passes. The screw 156 bears upon the curved surface 145 of the coupling pin 130 to provide resistance to rotation of the pin 130. Preferably, the edges of the inserted end 144 of the pin 130 are chamfered so that end 144 may slide past the protruding portion of the set screw 156 whenever the coupling pin 130 is inserted.

It can be appreciated that rotation of the bolt 125 relative to the coupling block 122 will adjust the position of the retainer plate hook 108 relative to the carriage crossbar 102. Preferably, the threaded portion of the bolt 125 is coated with a resilient material, such as nylon, so that the bolt may not be rotated in the absence of manual force.

It is noteworthy that the quick-detach mechanism 120 is sized so that at least part of the coupling block 122 remains between the coupling plates 126, 128 irrespective of whether the coupling pin 130 is in the inserted position (FIG. 4) or in the withdrawn position (FIG. 5). The coupling block 122, therefore, may not be rotated about the axis of the bolt 125. Consequently, the adjustment bolt 125 may be rotated at any time with a single wrench applied to the bolt head 127.

A rigid support bar 166 (FIG. 1) is attached between the vertical support members 40, 42 above the lower guide tubes 44, 48. The support bar 166 carries a spaced apart pair of hook brackets 168 that extend forwardly from the support bar 166 to secure the spread cylinder 270 of the fork assembly 26, as described more fully below.

The forks 54, 56, 58, 60 are all attached to guide bars that slide within the guide tubes 44, 48, 64, 66. More particularly, each outer fork 58, 60 includes a horizontal leg 172 and a vertical leg 174. Near the top of the vertical leg 174 of the right outer fork 58, a rigid upper ear 176 is attached to protrude from the rearward surface 178 of the vertical leg 174. The ear 176 is received within a correspondingly shaped slot formed in one end of an elongated upper right guide bar 180. A pair of fasteners 181 are used for securing the guide bar 180 to the ear 176.

The upper right guide bar 180 is generally square in cross section and fits within the upper right guide tube 64 of the frame 22. The free end 182 of the guide bar 180 is substantially enclosed in a two-part slide 184 that is formed of low-friction material, such as the NYLATRON product mentioned above. The slide 184 includes a top part 186 that fits over the top of the free end 182 of the guide bar 180, and a bottom part 188 that fits over the bottom of the bar 180. Preferably, the slide is removably attached to the bar 180 for easy replacement in the event of excessive wear. One method for such attachment is to include on the inside surface of each slide part 186, 188 a protrusion (not shown) that mates with a correspondingly shaped recess in the surface of the bar 180.

The slide 184 is of a thickness that substantially fills the space between the guide bar 180 and the interior walls of the guide tube 64 when the former is inserted into the latter. The slide 184 facilitates sliding movement of the bar 180 relative to the tube 64 as the outer fork 58 is driven as described more fully below.

The end of the upper right guide tube 64 includes a slot 190 arranged to provide clearance for the ear 176 that connects the upper end of the fork 58 to the guide bar 180. Such clearance is necessary when the outer fork is moved inwardly beyond the outer end of the tube 64.

Another two-part slide 185, which is formed of the low-friction NYLATRON product mentioned above, is mounted inside the slotted end of the upper right guide tube 64. The slide 185 includes a top part 187 that fits between the upper inside surface of the tube 64 and the top of guide bar 180, and a bottom part 189 that fits between the bottom inside surface of the tube 64 and the bottom of the bar 180. Preferably, the slide is removably attached to the tube 64 for easy replacement in the event of excessive wear. One method for such attachment is to include on the outside surface of each slide part 187, 189 a protrusion 191 that mates with a correspondingly shaped recess (not shown) in the inside surface of the tube 64.

The slotted ends of all of the guide tubes 44, 48, 64, 66 include slides substantially identical to the just-described slide 185. For clarity, only one such slide is shown in the drawings.

The left outer fork 60 and attached components are substantially identical to those of the right outer fork 58. Accordingly, an upper ear 192 is fastened between the vertical leg 174 of the left outer fork 60 and one end of an upper left guide bar 194. The upper left guide bar 194 carries on its free end a two-part slide 196. The upper left guide bar 194 slides, via slide 196, within the upper left guide tube 66, which tube 66 includes a slot 198 formed therein for providing clearance for the ear 192 whenever the left outer fork 60 is moved inwardly beyond the outer end of the tube 66.

The bases of the vertical legs 174 of the outer forks 58, 60 are attached to guide bars 200, 202 that slide within the lower guide tubes 44, 48. The lower right guide bar 200 and attached components are substantially similar to the corresponding upper right guide bar 180, except that the lower right guide bar 200 carries a lengthwise guide slot 204, the function of which will be described. Specifically, the lower right guide bar 200 is fastened at one end to the fork 58 by an ear 206 that is connected between the fork 58 and the bar 200. The free end of the lower right guide bar 200 has a two-part slide 208 attached thereto. The lower right guide bar 200 slides within the lower right guide tube 44. The lower right guide tube 44 includes a clearance slot 210 that extends inwardly to a location near the center of the tube 44. The clearance slot 210 accommodates, in addition to the ear 206, a guide plate 212 that is carried by the inner right fork 54 as described more fully below.

The lower left guide bar 202 is substantially identical to the lower right guide bar 200. Specifically, the lower left guide bar 202 is fastened at one end to the outer left fork 60 by an ear 214 that is connected between the fork 60 and bar 202. The free end of the lower left guide bar 202 has a two-part slide 216 attached thereto. The lower left guide bar 202 slides within the lower left guide tube 48. The lower left guide tube 48 includes a clearance slot 218 that extends inwardly toward a location near the center of the tube 48. The clearance slot 218 accommodates, in addition to the ear 214, a guide plate 220 that is carried by the inner left fork 56 as described more fully below.

Figure 6:
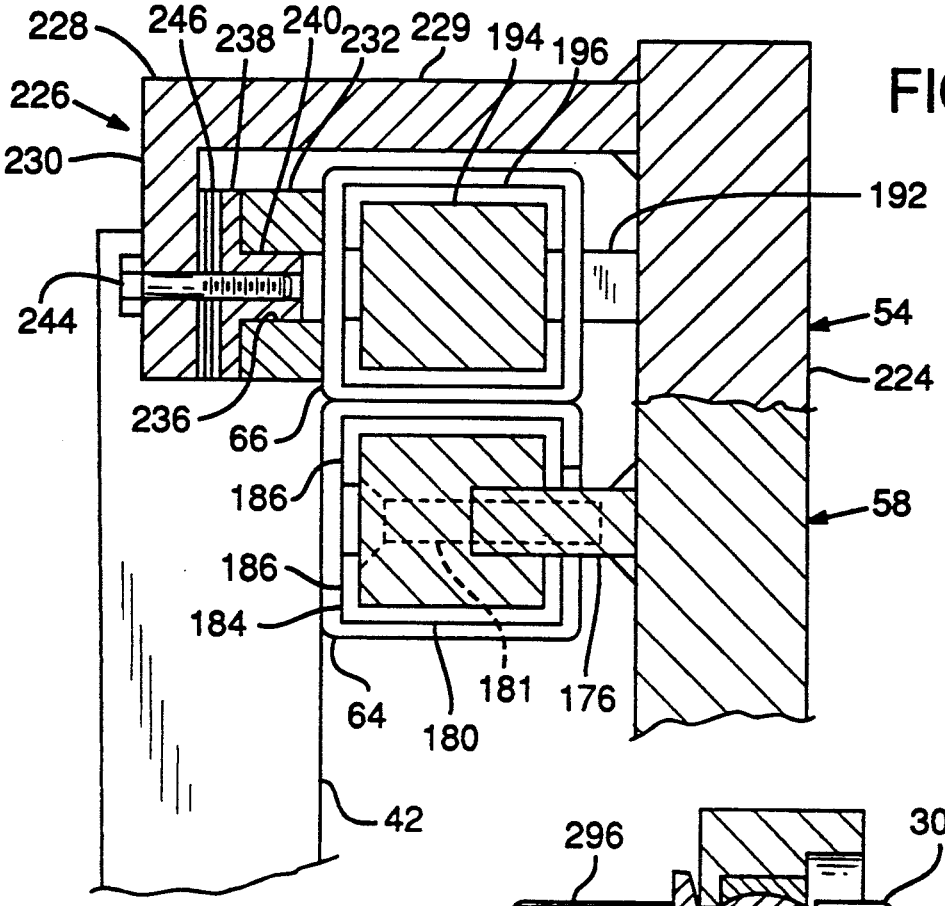
FIG. 6 is an enlarged cross-sectional view taken along line 6—6 of FIG. 3 showing a portion of the guide assembly for supporting and guiding lateral movement of the forks.

Each inner fork 54, 56 includes a horizontal leg 222 and a vertical leg 224. Looking first at the inner right fork 54, the upper end of the vertical leg 224 thereof includes a sliding hook assembly 226 for mounting the upper end of the vertical leg 224 to slide along the upper left guide tube 66 (FIG. 6). The sliding hook assembly 226 includes an L-shaped bracket 228 that is fastened to the fork 54. The bracket 228 includes a horizontal part 229 that extends outwardly from the fork 54 over the guide tube 66. The L-shaped bracket 228 also includes a vertical part 230 that has a slide pad 232 mounted thereto. Preferably, the slide pad 232 is formed of the low-friction UHMW material mentioned above.

The slide pad 232 includes two aligned apertures 236. Two cylindrical protrusions 240 of a rigid mounting plate 238 are press-fit partly into the apertures 236 in the slide pad 232. The protrusions 240 include a threaded bore into each of which is threaded a fastener 244 that also extends through the vertical part 230 of the L-shaped bracket 228. Shims 246 are positioned between the mounting plate 238 and vertical part 230 of the bracket 228 to adjust the position of the inner fork 54 so that the upper surface of the horizontal leg 222 of that fork is substantially coplanar with the upper surface of the horizontal leg 172 of the right outer fork 58.

The slide pad 232 slides against the rearward vertical surface 234 of the upper left guide tube 66. The upper ends of the left and right vertical support members 40, 42 are relatively narrow near the vertical guide tube 66 (and widest at the mid-portion of the support member for greatest resistance to bending) and arranged so that the sliding hook assembly 226 does not contact the right vertical support member 42 as the inner fork 54 is driven.

The left inner fork 56 is slidably mounted to the upper left guide tube 66 by a sliding hook assembly that is substantially identical to the sliding hook assembly described with respect to the right inner fork 54. Accordingly, the sliding hook assembly 226 associated with the left inner fork 56 is shown in the drawings with the same reference numerals as those of the previously described assembly.

The lower ends of the inner forks 54, 56 are retained near the lower guide tubes 44, 48. Looking first at the right inner fork 54, the rearward surface 248 of the right inner fork vertical leg 224 carries an L-shaped (in cross section) retainer bracket 250. As best shown in FIG. 2, the retainer bracket 250 includes a vertical leg 252 that normally resides next to, but is spaced from, a vertical leg 254 of an angle bracket 256 that is fastened to the upper surface of the lower left guide tube 48.

In the event that the lower end of the inner fork 54 is swung away from the guide tube 48 (for example, when the base of the fork 54 encounters an obstruction while the lift truck is moving in reverse), the vertical leg 252 of the retainer bracket 250 will abut the vertical leg 254 of the angle bracket 256 to prevent the lower end of the fork assembly 26 from moving away from the frame 22. The length of the retainer bracket 250 (that is, in the direction perpendicular to the plane of FIG. 2) and of the angle bracket 256 is selected so that at least part of the vertical legs 252, 254 of those brackets will remain next to one another, irrespective of lateral movement of the inner right fork 54.

The inner left fork 56 is retained adjacent to the lower guide tubes 44, 48 in a manner substantially identical to that just described with respect to the right inner fork 54. Accordingly, a retainer 250 and angle bracket 256 are depicted in the figures in association with both the right inner fork 54 and the left inner fork 56.

The lower ends of the vertical legs 224 of the inner forks 54, 56 carry guide plates 212, 220 that fit within the guide slots 204, 205 in the lower guide bars 200, 202. The guide plates 212, 220 guide lateral sliding movement of the inner forks 54, 56 relative to the outer forks 58, 60. More particularly, and looking first at the right inner fork 54, a rigid generally horizontally disposed guide plate 212 is fastened to extend inwardly and rearwardly from the right inner fork 54. A gusset plate 258 is fastened between the inner fork 54 and the guide plate 212 to support the plate 212 in the position shown. The rearward edge of the guide plate 212 is covered with a slide 260 of low-friction material, such as the NYLATRON product described above. The slide-covered edge of the guide plate 212 fits into the guide slot 204 formed in the lower right guide bar 200. The slide 260 facilitates sliding of the right inner fork 54 relative to the right outer fork 58 whenever the right outer fork 58 is driven outwardly from the right inner fork 54, as described more fully below.

The guide plate 220 that is mounted to the left inner fork 56 is substantially identical to the guide plate 212 carried by the right inner fork 54. The slide-covered rearward edge of that guide plate 220 fits into the guide slot 205 formed in the lower left guide bar 202.

The height of the support members 40, 42 is selected so that (1) the size of the components that are necessary for resisting the load moment may be minimized, hence minimizing the attachment weight and the lost load distance, and (2) the lift truck operator is better able to view the forks while operating the truck.

More particularly, with reference to FIG. 2, whenever a load is carried by the horizontal leg of a fork, for example, the inner right fork 54, a moment of force or "load moment" is transmitted to the vertical leg 224 of the fork 54. That load moment tends to rotate forward (see arrow 262, FIG. 2) the top of the fork vertical leg 224 about the base 264 of the fork. The magnitude of this load moment is a function of the weight of the load and the distance (or load moment arm) between the center of gravity of the load and the base 264 of the fork. The structural components of the fork attachment for supporting the upper and lower ends of the forks against rotation must be strong enough to support a reaction moment for resisting the load moment. The magnitude of the reaction moment is a function of the distance (reaction arm) between the base 264 of the fork and the location where the upper end of the fork is fixed against forward rotation. In the present invention, this latter location is where the slide pad 232 carried by each inner fork 54, 56 bears against the rearward surface 234 of the upper left guide tube 66. For outer forks 58, 60, the location where the fork is fixed against forward rotation occurs where the upper ears 176, 192 are fastened to the forks. The guide assembly of the present invention, which comprises guide bars 180, 194, 200, 202, and guide tubes 44, 48, 64, 66, is constructed so that the upper guide tubes 64, 66 are spaced a substantial distance from the lower ends of the forks, above the upper crossbar 34 of the lift truck carriage. Consequently, the reaction arm is greatly increased over, for example, the reaction arm provided by an arrangement where the vertical legs of the forks are fixed against forward rotation at a location very near the upper crossbar 34.

The just-described extended reaction arm resulting from the position of the upper guide tubes 64, 66 has the effect of reducing the magnitude of the load force that is applied to the upper and lower guide bars and guide tubes. Accordingly, the size of the guide bars 180, 194, 200, 202 and guide tubes 44, 48, 64, 66 may be smaller than what would be required if the upper ends of the forks were fixed nearer to the upper crossbar 34 (hence defining a smaller reaction arm). The reduction in the size of the guide assembly components correspondingly minimizes the lost load distance (shown as L in FIG. 2) and weight of the attachment of the present invention.

As best shown in FIG. 3, the raised position of the vertical guide tubes 64, 66 creates a wide window W through which the lift truck operator may view the forks while moving the forks into and out of pallet pockets. In a preferred embodiment of the invention, the height of the window (that is, the distance between the rounded end 30 of the anchor plate 28 and the underside of the upper right guide tube 64) is greater than about 16 inches.

Each outer fork 58, 60 is independently driven by an associated hydraulic cylinder 266, 268. The inner forks 54, 56 are simultaneously driven inwardly and outwardly by a spread cylinder 270 as described more fully below.

Figure 7:
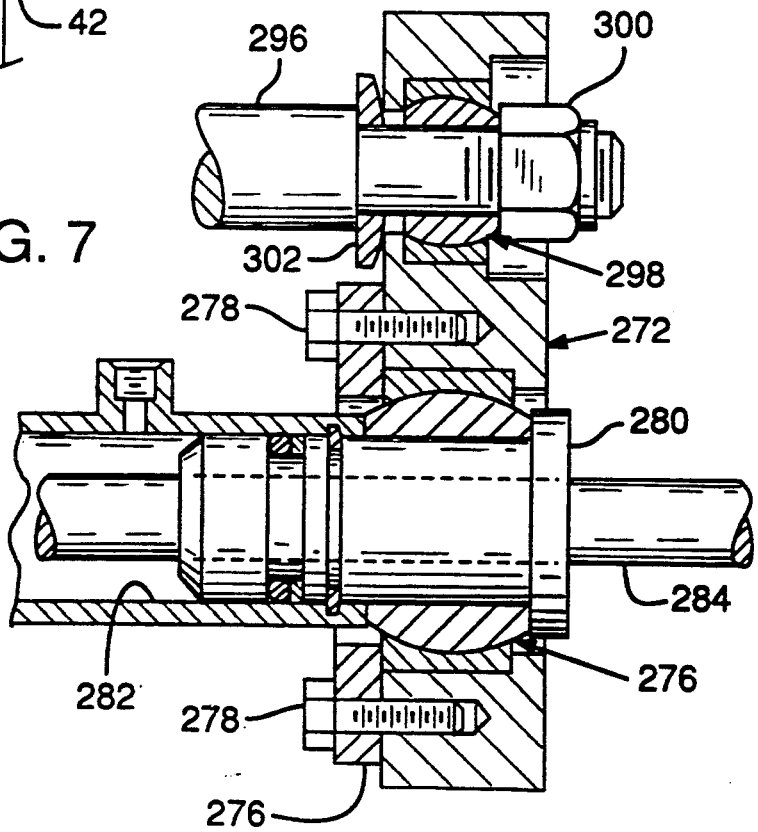
FIG. 7 is an enlarged cross-sectional view taken along line 7—7 of FIG. 1.

With reference to FIGS. 1 and 7, the cylinder 266 that moves the right outer fork 58 (hereafter referred to as the right cylinder 266) is mounted to a right mounting block 272 and to a right rod bracket 286. The right mounting block 272 projects rearwardly from the rearward surface 248 of the right inner fork 54 and carries a conventional spherical bearing 276. The spherical bearing 276 is secured within a correspondingly shaped opening in the right mounting block 272 by a lock ring 276 that is fastened to the right mounting block 272 by fasteners 278. A gland 280 is fit through one end of the spherical bearing 276 and is locked and sealed within the open end 282 of the right cylinder 266.

The rod 284 of the right cylinder 266 extends through the gland 280. The outer end of the rod 284 is fastened to the rod bracket 286 that is carried on the rearward surface 178 of the right outer fork 58. The right cylinder 266 is a dual action type that is actuatable as described below for extending and retracting the rod 284 relative to the mounting block 272, hence moving the outer right fork 58 away from or toward the inner right fork 54.

The cylinder 268 that moves the left outer fork 60 (hereafter referred to as the left cylinder 268) is mounted to a left mounting block 288 and to a left rod bracket 290. The left mounting block 288, which is fastened to the rearward surface 249 of the left inner fork 56, includes a conventional spherical bearing 292 carried therein in like manner to the bearing 276 carried in the right mounting block 272.

The rod 294 of the left cylinder 268 extends through the bearing 292 and is fastened at its end to the rod bracket 290 carried on the left outer fork 60. The left cylinder 268 is a dual action type that is actuatable as described below for extending and retracting the rod 294 relative to the mounting block 288, hence moving the left outer fork 60 away from and toward the left inner fork 56.

The spread cylinder 270 comprises two back-to-back cylinders that are simultaneously driven to move together or apart the inner forks 54, 56. The spread cylinder 270 is connected between the right mounting block 272 and the left mounting block 288. In this regard, the end of one rod 296 of the spread cylinder 270 is fastened, via nut 300 and washer 302, to a spherical bearing 298 that is mounted within the right mounting block 272 above the earlier-described spherical bearing 276. The end of the other rod 304 of the spread cylinder 270 is similarly fastened to a spherical bearing carried in the left mounting block 288 beneath the earlier-described spherical bearing 292.

An annulus 306 is attached between the ends of the spherical cylinder 270 and shaped to fit between the hook brackets 168 that extend forwardly from the support bar 166 of the frame 22. The hook bracket and annulus arrangement keep the spread cylinder centered relative to the frame 22.

With reference to FIGS. 1, 3, the right cylinder 266 and left cylinder 268 are independently operable for moving the right outer fork 58 and left outer fork 60, respectively. The spread cylinder 270 is independently operable for moving the inner forks 54, 56. As noted, the right cylinder 266 is mounted via block 272 to the right inner fork 54, and the left cylinder 268 is mounted via block 288 to the left inner fork 56. Accordingly, any movement of the inner forks will also move the outer forks a corresponding amount.

As best shown in FIG. 3, the hereafter described hydraulic control system may be actuated to move the inner forks 54, 56 into any position within the lateral range designated by the arrow 308. Preferably, the width of this range 308 is about 6 inches.

The right cylinder 266 and left cylinder 268 may be separately actuated to respectively move the right outer fork 58 and left outer fork 60 into any position within the lateral range designated by the arrow 310 in FIG. 3. Preferably, the width of the lateral range 310 is 24 inches. Such movement of the outer forks 58, 60 does not affect movement of the inner forks 54, 56. Only the lateral range for the left forks 56, 60 is depicted in FIG. 3, but it is understood, that the same ranges apply to the right forks 54, 58.

As noted earlier, the lower guide tubes 44, 48 and upper guide tubes 64, 66 are inclined relative to horizontal. The guide bars 200, 202, 180, 194 that slide within those tubes are sized to fit with a small amount of clearance between the bar and tube. Accordingly, whenever a bar is fully extended out of a tube, the bar tends to sag slightly downward. The inclination of the guide tubes compensates for the sag so that horizontal legs 172 of the fully extended outer forks 58, 60 will be substantially level with the horizontal legs of the inner forks 54, 56.

With reference to FIGS. 8-11, this description now turns to the hydraulic control system for controlling the functions of the dual pallet fork attachment described above.

The four functions carried out by the hydraulic 35 control system are: (1) spread cylinder 270 actuation for moving the inner forks 54, 56; (2) shift cylinder 80 actuation for laterally shifting the fork assembly 26; (3) right cylinder 266 actuation for moving the right outer fork 58; and (4) left cylinder 268 actuation for moving the left outer fork 60.

The hydraulic control system controls the four functions without the need for mounting any electrically driven components on the attachment 20. In this regard, the components depicted within box 312 of the schematic diagrams of FIGS. 8-11 are carried on the lift truck. The components depicted in box 314 are carried on the fork attachment 20. It is noteworthy that only four hydraulic lines: a first pressure/return line 316, a second pressure/return line 318, a first pilot line 320, and a second pilot line 322, are extended over the carriage mast of the lift truck. No electrical conductors extend between the attachment and the truck.

In general, the hydraulic control system is operable for directing pressurized fluid to line 316 (with line 318 serving as the return line) or to line 318 (with line 316 serving as the return line). Lines 316, 318 define a primary working-fluid circuit to which all four cylinders 80, 266, 268, 270 are connected. Also connected to the primary circuit are three pilot-operated two-position control valves: a forks control valve 324, a shift/spread control valve 326, and a branch control valve 328. The control valves are operated, as described more fully below, for placing a selected one of the four cylinders 80, 266, 268, 270 in fluid communication with the primary circuit to carry out the function that is performed by the selected cylinder. Preferably, the control valves 324, 326, 328 are those manufactured by Compact Controls, Hillsboro, Oreg., as model No. CP720-1-B.

The control valves 324, 326, 328 are housed within the above-mentioned valve assembly 330, which is mounted to the lower right guide tube 48 of the attachment frame. The valve assembly 330 is directly connected to three of the four hydraulic lines 318, 320, 322 that extend between the truck and the attachment 20. The valve assembly 330 is also directly connected to four other hydraulic lines for establishing fluid communication between the valve assembly 330 and each of the four cylinders 80, 266, 268, 270. Those lines are shift line 332, right fork line 334, left fork line 336, and spread line 338.

The branch control valve 328 is connected within the valve assembly 330 to the forks control valve 324 via a first branch line 340, and to the shift/spread control valve 326 via second branch line 342.

Figure 8:
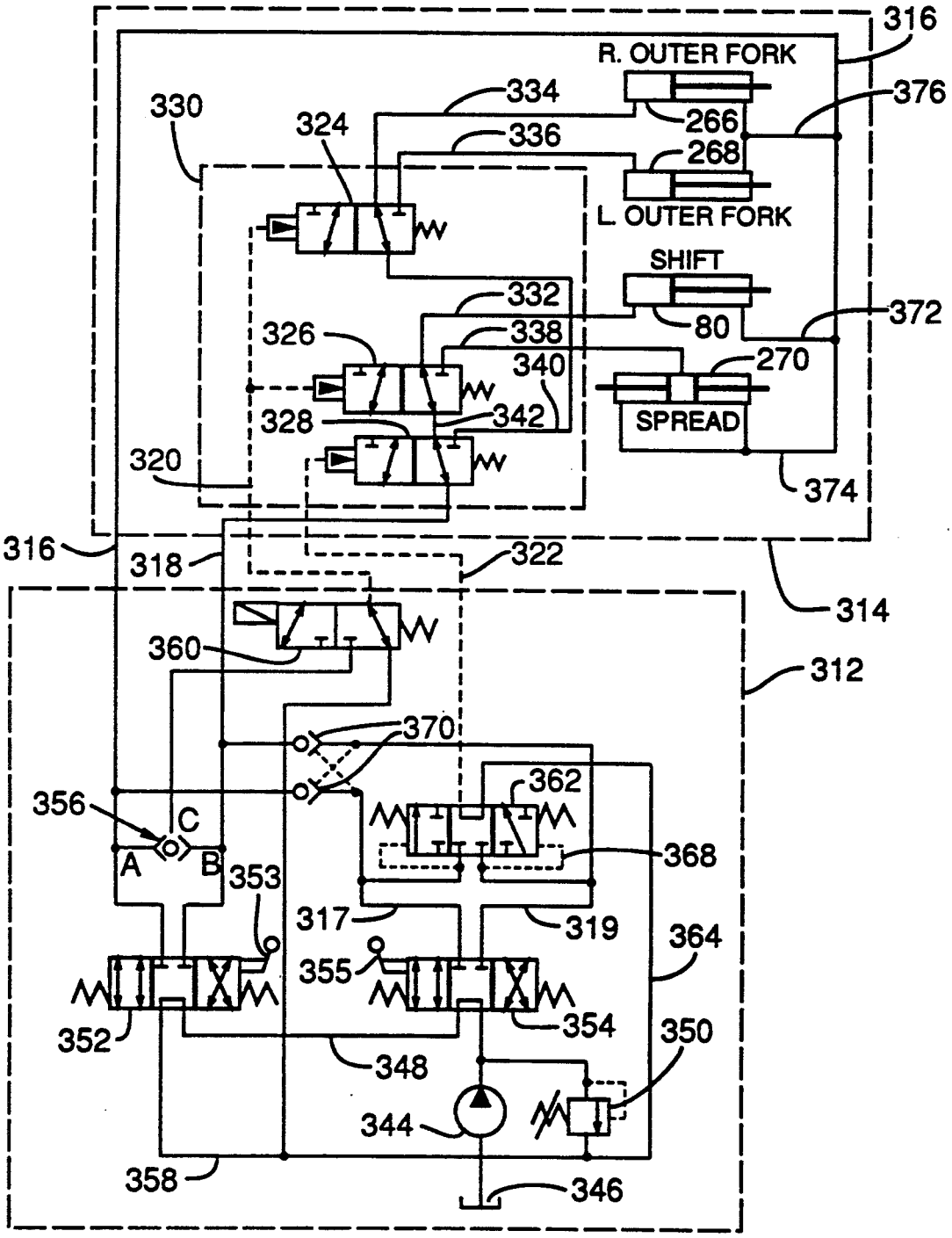
FIGS. 8–11 are schematic diagrams of the hydraulic control system employed for controlling the four functions of the attachment. Each figure shows the circuit arrangement corresponding to a particular one of the four functions.
Figure 9:
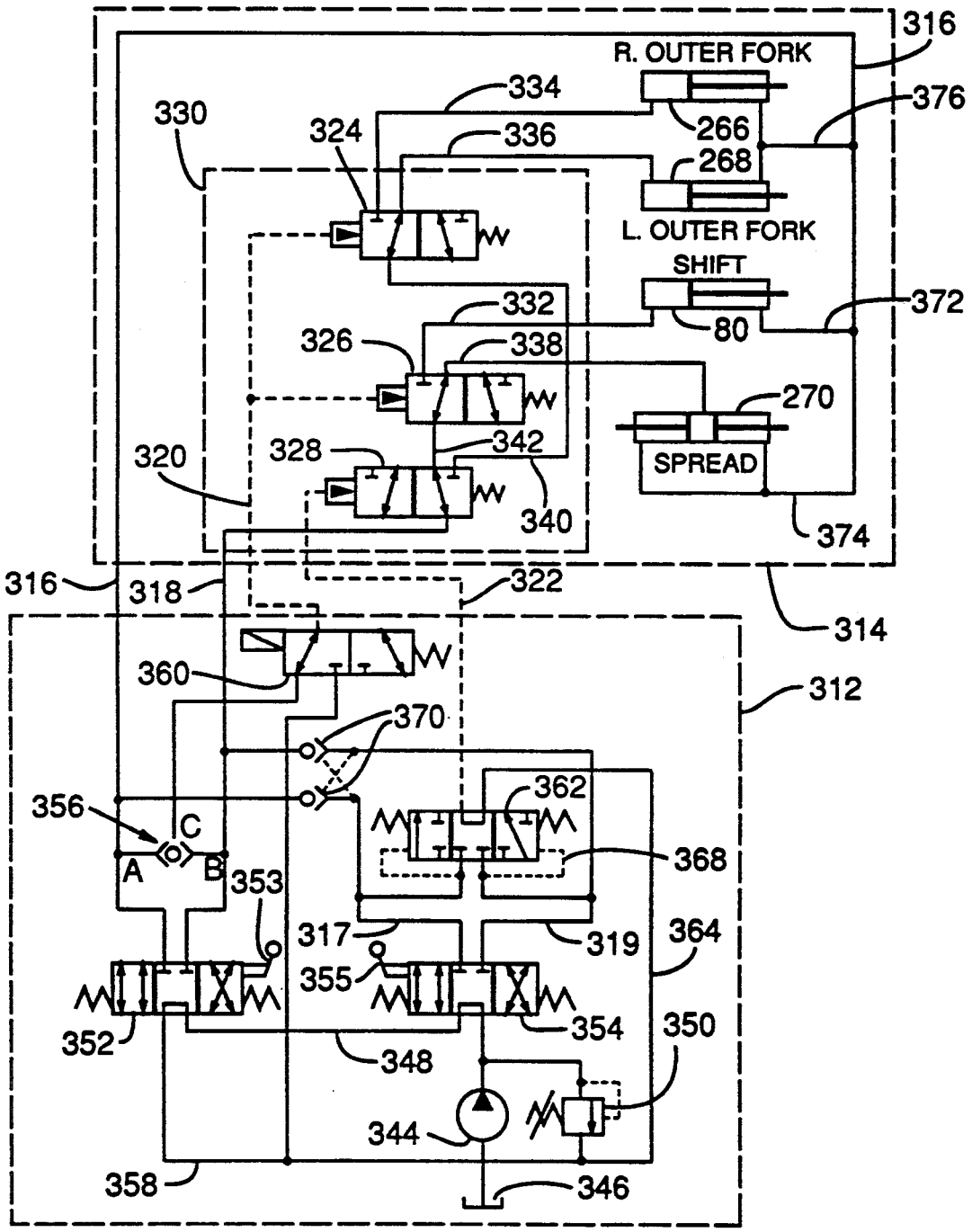

The control valves 324, 326, 328 are each movable between two positions. As used herein, the first position means the position depicted for all control valves 324, 326, 328 in FIG. 8. The second position means the position depicted for all control valves in FIG. 11. For example, FIG. 9 depicts control valves 324, 326 in the second position and control valve 328 in the first position. The method for changing the position of the control valves to carry out a selected cylinder function is now described with reference first to the hydraulic circuit components shown in box 312 (FIG. 8).

A pump 344 pumps fluid from a hydraulic fluid reservoir tank 346 to maintain pressurized fluid in line 348. A pressure relief valve 350 is connected between the line 348 and the tank 346 for relieving over-pressure in line 348.

Line 348 provides fluid to two separate lever-operated selector valves 352, 354. Preferably, the levers 353, 355 associated with those valves are within reach of the lift truck operator. As will become clear, the first selector valve 352 is operable for controlling the shift cylinder 80 and the spread cylinder 270. The second selector valve controls the left and right fork cylinders 266, 268.

The first selector valve 352 is movable out of the neutral position shown in FIGS. 8-11 for applying the pressurized fluid in line 348 to either one pressure/-return line 316 or the other pressure/return line 318. The direction of motion (extend or retract) of the selected shift cylinder 80 or spread cylinder 270 depends upon whether pressurized fluid is directed by the valve 352 to one pressure/return line 316 or the other 318. For the purposes of this description, actuation of selector valve 352 will be considered as moving the valve into a position (to the right in FIG. 8) for directing pressurized fluid in line 348 to line 318 with line 316 serving as the return line. It is clear, however, that the first selector valve 352 may be moved (to the left in FIG. 8) for directing pressurized fluid to line 316 so that line 318 serves as the return line.

A shuttle valve 356 is connected by lines A and B between the two pressure/return lines 316, 318. The shuttle valve 356 serves to direct through line C pressurized fluid to a pilot control valve 360, irrespective of whether line 316 or 318 is pressurized.

The pilot control valve 360 is a solenoid-driven two-position valve that normally assumes a first position (FIG. 8), but can be moved into a second position (FIG. 9) whenever the solenoid is actuated. Preferably, the solenoid is actuated by closing a switch (not shown) that is mounted to the lever 353 of the first selector valve 352.

The second selector valve 354 is operable for applying pressurized fluid to line 316 over connected line 317, or to line 318 over connected line 319. The second selector valve 354 includes a switch that is mounted to the lever 355 for actuating the solenoid-driven pressure control valve 360.

Whenever the second selector valve 354 is in the neutral position (FIG. 8), an associated shuttle valve 362 connects the second pilot line 322 to the tank 346 via return line 364. As the second selector valve 354 is moved out of the neutral position (for the purpose of controlling movement of either the left or right fork cylinder 266, 268), the shuttle valve 362, which is connected to both lines 317, 319 that emanate from the second selector valve 354, responds to the pressure in line 317 or 319 (depending upon which direction the selector valve 354 is moved) by directing pressurized pilot fluid over second pilot line 322 to the branch control valve 328.

A pilot operated check valve 370 is connected to each of the lines 317, 319 that connect the second selector valve 354 to the lines 316, 318 of the primary circuit. The check valves 370 close whenever the second selector valve 354 is in the neutral position so that the shuttle valve 362 will remain in the neutral position, unaffected by the operation of the first selector valve 352.

Turning now to the operation of the hydraulic control circuit, and looking first at the operation of the shift cylinder 80 with particular reference to FIG. 8, the operator moves the first selector valve 352 to the right in FIG. 8 to extend the rod end of the shift cylinder 80 (as noted, the selector valve 352 could be moved to the left in FIG. 8 for the purpose of retracting the rod end of the shift cylinder 80). The switch for actuating the solenoid of the pilot control valve 360 is not closed. Consequently, the pilot control valve 360 remains in the first position shown in FIG. 8. Accordingly, first pilot line 320 is connected to the tank 346, and the associated forks control valve 324 and shift/spread control valve 326 remain in the first position, as shown in FIG. 8. Moreover, because the second selector valve 354 remains in the neutral position, the second pilot line 322 is connected via line 364 to the tank 346. Accordingly, the branch control valve 328 remains in the first position.

With the control valves 324, 326, 328 positioned as just described, pressurized fluid directed over line 318 moves through branch line 342 and shift line 332 to actuate the shift cylinder 80. Return fluid is directed over line 372 to the pressure/return line 316.

With particular reference to FIG. 9, the spread cylinder is operated whenever the first selector valve 352 is moved out of the neutral position (for example, to the right in FIG. 9), and the solenoid of the pilot control valve 360 is actuated by the operator to move the valve 360 into the second position. With the pilot control valve 360 in the second position, pressurized fluid directed from the shuttle valve 356 over line C reaches the first pilot line 320 to force both the forks control valve 324 and shift/spread control valve 326 into the second position (FIG. 9). The neutral-positioned second selector valve 354 keeps the shuttle valve 362 in the neutral position so that the branch control valve 328 remains in the first position.

With the control valves 324, 326, 328 positioned as just described, pressurized fluid in line 318 is directed via branch control valve 328 to the shift/spread control valve 326 over second branch line 342. From the control valve 326, the pressurized fluid is directed over spread line 338 to actuate the spread cylinder 270 to separate the inner forks 54, 56. Return fluid from the spread cylinder 270 is directed over line 374 to the return line 316.

Figure 10:
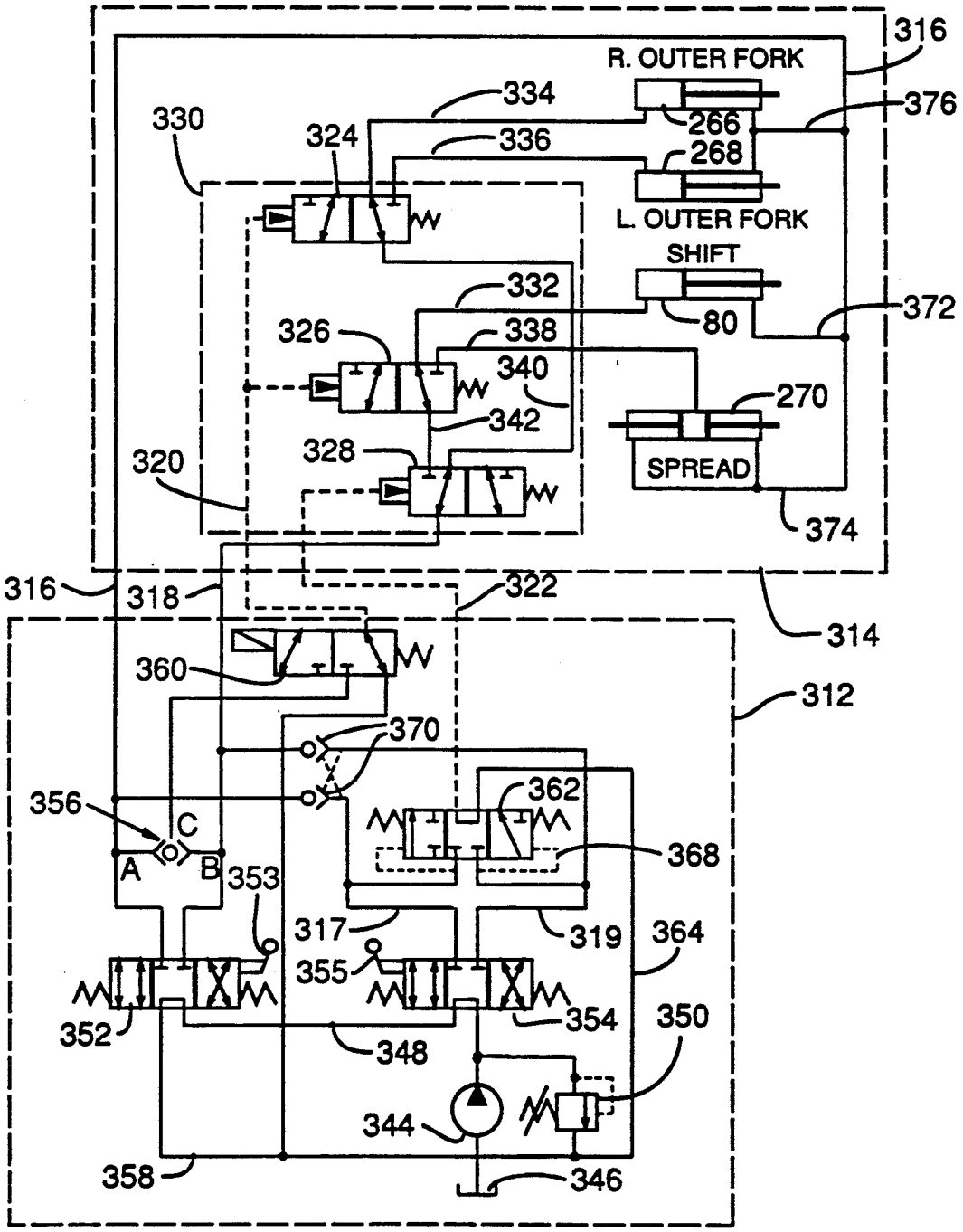

With particular reference to FIG. 10, the operation of the right fork cylinder 266 is now described. The operator moves the second selector valve 354 to a position, for example, to the right in FIG. 10, for applying pressurized fluid in line 348 to the connector line 319. The shuttle valve 362 is shifted to the left as pressure in line 319 is directed to pilot line 368. When the shuttle valve 362 is shifted to the left, second pilot line 322 becomes pressurized and forces the branch control valve 328 to shift to the second position. The pilot control valve 360 remains in the first position because the operator does not close the switch for actuating the solenoid of that valve 360.

With the control valves 324, 326, 328 positioned as just described, pressurized fluid delivered to line 318 via line 319 passes through the branch control valve 328 over first branch line 340 to reach the forks control valve 324. With the pilot control valve 360 in the first position, the forks control valve remains in the first position, hence, directing pressurized fluid over right fork line 334 to actuate the right fork cylinder 266. Return fluid from the right cylinder 266 is connected via line 376 to pressure/return line 316.

Figure 11:
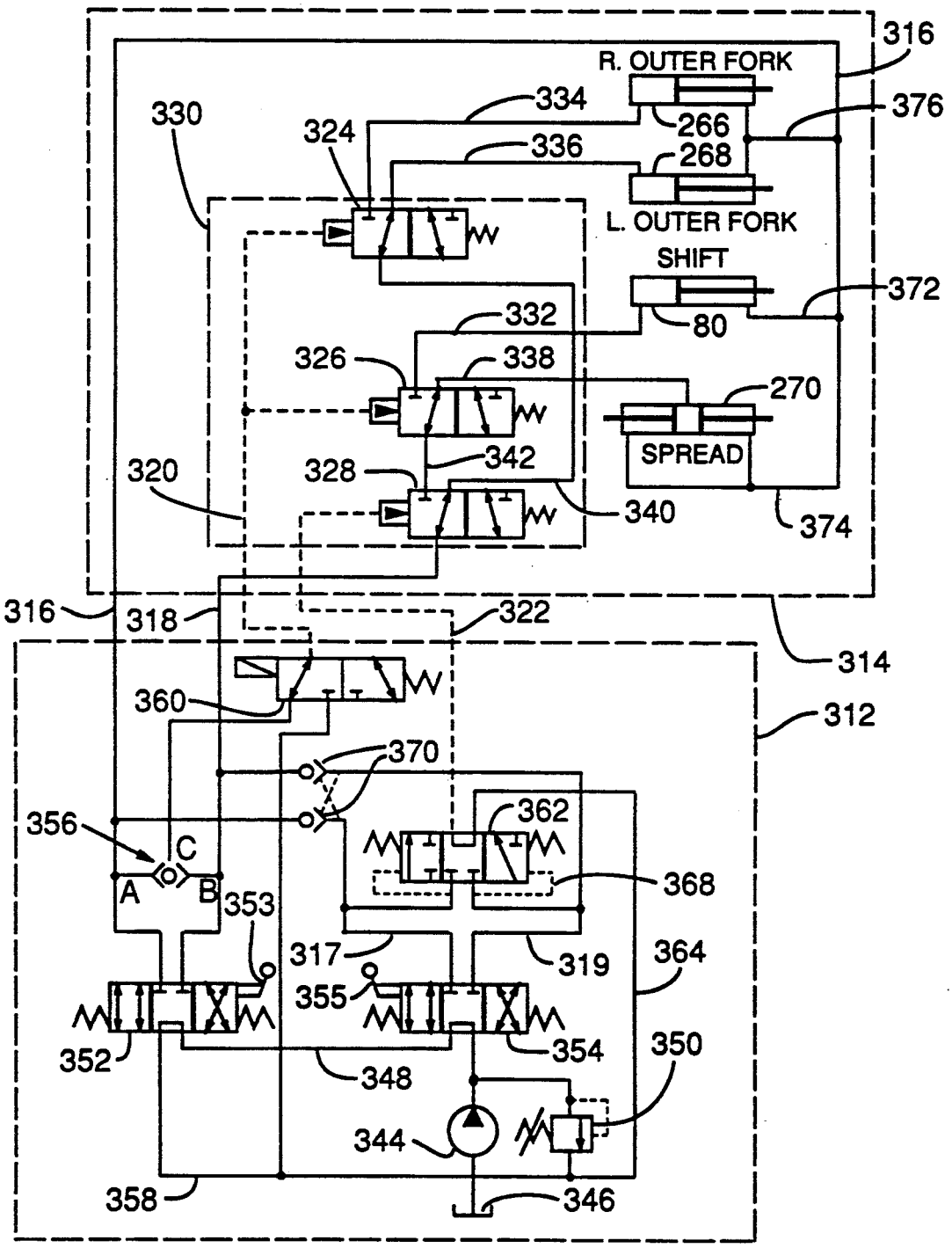

With particular reference to FIG. 11, control of the left fork cylinder 268 is now described. The second selector valve 354 is moved out of the neutral position (for example, to the right in FIG. 11) to apply pressurized fluid over line 319 to line 318. As before, the pressure in pilot line 368 shifts the shuttle valve 362 so that pressurized fluid is again applied to second pilot line 322 to move the branch control valve 328 to the second position shown in FIG. 11. Moreover, the switch on lever 355 is closed, thereby actuating the solenoid of pilot control valve 360 so that pressurized fluid delivered from shuttle valve 356 over line C will be directed by the pilot control valve 360 to the first pilot line 320. The pressure in line 320 moves the forks control valve 324 and shift/spread control valve 326 into the second position as shown in FIG. 11.

With the control valves 324, 326, 328 positioned as just described, pressurized fluid in line 318 is directed through the branch control valve 328 through the first branch line 340 to the forks control valve 324. In the second position, the forks control valve 324 directs the pressurized fluid to the left fork line 336 for actuating the left fork cylinder 268. Return fluid from the left fork cylinder 268 is connected via line 376 to the pressure/-return line 316.

It should be apparent that the dual pallet fork attachment of the present invention can be modified in arrangement and detail without departure from the principals underlying the invention. Accordingly, while the present invention has been described with respect to a preferred embodiment, it will be understood that the full scope of the invention is described in the appended claims.

We claim:

1. A lift truck attachment for handling loads, comprising:

a frame having mounting means for releasable attachment to the carriage of a lift truck;

a first pair of load lifting fork members, said frame having a lateral bearing surface and mounting means mounting said first pair of fork members to said bearing surface for independent lateral sliding movement of the fork members relative to each other on said frame;

a second pair of load lifting fork members, and mounting means mounting said second pair of fork members to said bearing surface for independent slidable movement of the fork members relative to each other on said frame;

first actuation means mounted between the fork members of the first pair of fork members for spacing and controlling the spacing between the fork members of the first pair of fork members;

second actuation means mounted between the fork members of the second pair of fork members for spacing and controlling the spacing between the fork members of the second pair of fork members, the first and second actuation means being operable independently of one another; and third actuation means controlling the distance between the first pair of fork members and the second pair of fork members, and mounting means mounting said third actuation means to said frame and to each of said pairs of fork members for equal and simultaneous opposed lateral sliding movement of said first pair of fork members relative to said second pair of fork members and both of said fork members of both of said first and second pairs of fork members all being simultaneously moved by said third actuation means relative to said frame.

2. A lift truck attachment as defined in claim 1 wherein:

mounting means are provided on said frame for releasable mounting of said frame to said carriage of said lift truck for lateral sliding movement of said frame relative to said lift truck; and fourth actuation means mounted to the frame and for mounting to the carriage for controlling the movement of the frame relative to the lift truck.

3. A lift truck attachment as defined in claim 2, wherein:

said frame includes an upper and a lower pair of laterally extended rigid guide tubes;

each of said fork members having an L-shape with vertical and horizontal legs and each of said pairs of legs having an outer leg and an inner leg;

an upper and a lower pair of guide bars slidably mounted in said upper and lower pairs of rigid guide tubes, each of said outer legs fixedly mounted at the top of its vertical leg to one of said upper guide bars and at the bottom of its vertical leg to one of the lower guide bars whereby one of said outer fork members is guided in a path of lateral movement by an upper and lower guide tube and the other of said outer fork members is guided in a path of lateral movement by the other upper and lower guide tubes; and each of said inner fork members slidably supported and guided by said guide tubes in the same path as the outer fork of the corresponding pair of forks.

4. A lift truck attachment as defined in claim 3 wherein the upper pair of guide tubes is spaced from the lower pair of guide tubes and the mounting and actuation means are configured and positioned relative to the spaced pairs of guide tubes to provide a substantial viewing window for the operator of the lift truck to view the movement of the forks.

5. A lift truck attachment as defined in claim 3 wherein each of said fork members are mounted at its upper end to an upper guide tube in a manner to prevent forward tipping of the fork members, said upper guide tube spaced substantially above the mounting of said frame to the lift truck thereby providing a viewing window for the operator and further providing a substantial moment arm of resistance to the bending force of a load carried on the fork members.

6. A lift truck attachment as defined in claim 3 wherein the guide tubes are slightly angled to guide the guide bars of the outer forks in an upwardly directed path as the forks are extended laterally in opposed directions.

7. A lift truck attachment as defined in claim 6 wherein the guide tubes are equally angled at about 0.5 degrees from horizontal.

8. A lift truck attachment for handling loads, comprising:

a frame and mounting means for releasable attachment of the frame to the carriage of a lift truck;

a first pair of load lifting fork members, said frame having a lateral bearing surface and mounting means mounting said fork members to said bearing surface;

a second pair of load lifting fork members, and mounting means mounting said fork members to said bearing surface;

said first and second pairs of fork members mounted for lateral sliding movement relative to the frame and mounted for opposed lateral sliding movement relative to each other; and said lateral bearing surface of said frame defining a guide path that is slightly angled to guide the pairs of fork members respectively in an upwardly and oppositely directed path as the pair of fork members are extended laterally in opposed directions.

9. A lift truck attachment as defined in claim 8 wherein the angles of the guide path of the first and second pairs of fork members are equal and oppositely directed.

10. A lift truck attachment as defined in claim 9 wherein each of said first and second guide means comprises upper and lower spaced guide tubes and upper and lower guide bars slidably guided in said guide tubes, each of said pair of fork members having an outer fork member and an inner fork member, said fork members being L-shaped with vertical and horizontal legs, and the vertical leg of each of said outer fork members attached to the corresponding upper and lower guide bars, said guide tubes guiding the respective outer leg members at an incline relative to each other to offset a bending force applied to the outer fork member as a result of a load carried thereby.

11. A lift truck attachment as defined in claim 10 wherein the vertical and horizontal legs of the fork members are substantially the same length and the guide bars are attached to the outer legs at the top and the bottom of the vertical legs thereof, said inner fork members slidingly mounted to the upper and lower guide tubes at the top and bottom of the vertical legs thereof whereby the guide tubes and guide bars are positioned to provide a window for operator viewing of the fork members and whereby the moment arm of the force resisting forward tipping of the fork members exceeds the moment arm of the force of the load carried on the horizontal legs.

12. A lift truck attachment as defined in claim 11 wherein a mounting member mounts said frame to said lift truck, said mounting member and frame configured in cooperation with said guide tubes to maintain the operator viewing window provided between the upper and lower guide tubes.

* * * * *